US009511583B2

(12) United States Patent
Biel et al.

(10) Patent No.: US 9,511,583 B2
(45) Date of Patent: Dec. 6, 2016

(54) PRINTING HEAD FOR MULTI-STROKE SCREEN PRINTING APPARATUS

(71) Applicant: M & R Printing Equipment, Inc., Glen Ellyn, IL (US)

(72) Inventors: Boguslaw Biel, Carol Stream, IL (US); Joel Zupancic, West Chicago, IL (US); Luis Miguel Hoefken, R., Lima (PE)

(73) Assignee: M&R Printing Equipment, Inc., Roselle, IL (US)

( * ) Notice: Subject to any disclaimer, the term of this patent is extended or adjusted under 35 U.S.C. 154(b) by 0 days.

(21) Appl. No.: 14/874,653

(22) Filed: Oct. 5, 2015

(65) Prior Publication Data

US 2016/0089874 A1 Mar. 31, 2016

Related U.S. Application Data

(62) Division of application No. 12/918,616, filed as application No. PCT/US2009/034747 on Feb. 20, 2009, now Pat. No. 9,150,041.

(Continued)

(51) Int. Cl.
*B41F 15/42* (2006.01)
*B41F 15/44* (2006.01)

(Continued)

(52) U.S. Cl.
CPC ..... *B41F 15/44* (2013.01); *B41F 15/0863* (2013.01); *B41F 15/42* (2013.01); *B41M 1/12* (2013.01)

(58) Field of Classification Search
CPC ... B41F 15/42; B41F 15/0863; B41F 15/0818; B41F 15/085; B41M 1/12

(Continued)

(56) References Cited

U.S. PATENT DOCUMENTS 4,407,195 A 10/1983 Jaffa
4,606,268 A 8/1986 Jaffa (Continued)

FOREIGN PATENT DOCUMENTS

AU 2009217338 A1 8/2009
DE EP 0423428 A2 * 4/1991 ..... B41F 15/46

(Continued)

OTHER PUBLICATIONS

European Patent Office, Extended European Search Report for EPO Application No. 09712838.3 mailed Feb. 29, 2012 (7 pages).

(Continued)

*Primary Examiner* — Leslie J Evanisko

(74) *Attorney, Agent, or Firm* — Nixon Peabody LLP

(57) ABSTRACT

A screen printing apparatus is described. The apparatus has a plurality of radial arms each having a printing head associated therewith. A target area is in alignment with at least one of the printing heads wherein a design is applied to a target article at the target area by the printing head. A means for providing relative movement between the target area and the printing head provides multiple passes between a squeegee associated with the printing head and the target area. A means for providing a pressure between the squeegee and the target area is regulated such that a first pressure between the squeegee and the target area on a first stroke is not equal to a second pressure between the squeegee and the target area on a subsequent second stroke.

14 Claims, 3 Drawing Sheets

Related U.S. Application Data

(60) Provisional application No. 61/030,804, filed on Feb. 22, 2008.

(51) Int. Cl.
*B41F 15/08* (2006.01)
*B41M 1/12* (2006.01)

(58) Field of Classification Search
USPC ..... 101/115, 123, 129
IPC ..... B41F 15/08
See application file for complete search history.

(56) References Cited

U.S. PATENT DOCUMENTS

| | | | | |
|---|---|---|---|---|
| 4,939,991 | A | 7/1990 | Szarka | |
| 4,949,636 | A * | 8/1990 | Tachibana | B41F 15/44 101/121 |
| 5,199,353 | A | 4/1993 | Szyszko | |
| 5,201,452 | A | 4/1993 | Takahashi et al. | |
| 5,575,206 | A | 11/1996 | Szyszko | |
| 5,592,877 | A | 1/1997 | Szyszko et al. | |
| 5,640,905 | A * | 6/1997 | Szyszko | B41F 15/0863 101/114 |
| D387,034 | S | 12/1997 | Szyszko et al. | |
| 5,787,805 | A | 8/1998 | Szyszko et al. | |
| 5,809,877 | A | 9/1998 | Szyszko et al. | |
| 5,845,569 | A | 12/1998 | Tkacz et al. | |
| 5,893,325 | A * | 4/1999 | Sakai | B41F 15/423 101/123 |
| 5,988,856 | A | 11/1999 | Braunstein et al. | |
| 6,637,326 | B1 | 10/2003 | Isogai et al. | |
| 6,748,856 | B2 * | 6/2004 | Witte | B41F 33/0009 101/127 |
| 9,150,041 | B2 | 10/2015 | Biel et al. | |

FOREIGN PATENT DOCUMENTS

| | | | |
|---|---|---|---|
| EP | 2257438 | A2 | 12/2010 |
| JP | 1-44848 | A | 2/1992 |
| JP | 04044848 | A * | 2/1992 |
| JP | 5-191012 | A | 7/1994 |
| JP | 10-193559 | A | 7/1998 |
| JP | 2003-048303 | A | 2/2003 |
| WO | 0200437 | A1 | 1/2002 |
| WO | 2009015693 | A2 | 8/2009 |

OTHER PUBLICATIONS

Intemational Preliminary Report on Patentability for PCT/US2009/034747 mailed Aug. 24, 2010 (1 pages).

United States Patent Office, International Search Report for PCT/US2009/034747 mailed Apr. 21, 2009 (2 pages).

United States Patent Office, Written Opinion of International Searching Authority for PCT/US2009/034747 mailed Aug. 21, 2009 (6 pages).

* cited by examiner

PRINTING HEAD FOR MULTI-STROKE SCREEN PRINTING APPARATUS

CROSS-REFERENCE TO RELATED APPLICATIONS

This application is a divisional of U.S. application Ser. No. 12/918,616 filed on Apr. 28, 2011, now U.S. Pat. No. 9,150,041 issued on Oct. 6, 2015 which is a 371 filing of International Application No. PCT/US2009/034747 filed Feb. 20, 2009, which claims the benefit of U.S. Provisional Application No. 61/030,804 filed Feb. 22, 2008, all of which are hereby incorporated by reference as if fully set forth herein.

TECHNICAL FIELD

The present invention relates generally to printing machines and, more particularly, to a multi-stroke printing head with variable pressure.

BACKGROUND OF THE INVENTION

Typically, in a print stroke of a screen printing machine, a squeegee will pass over the screen once, pushing the ink through the mesh openings in the screen. Some systems will have a feature permitting a second print stroke, or a second pass over the screen. It is widely believed that this will produce a thicker and smoother image on the textile being printed upon. The second print stroke, if selected, will be at the same pressure as the first stroke. It is well known that squeegee pressure, which translates to the pressure or force the squeegee places upon the screen during the print stroke, affects the amount of ink pushed through the gaps or openings on the screen and onto the textile being printed upon. Accordingly, many falsely believe the more ink deposited upon the textile, the better the results. This is wrong in many instances. Merely adding pressure to the squeegee and/or adding print strokes does not always improve the quality of the finished product.

Rather, it has been found that for several reasons, customizing the pressure of the strokes and the adding of strokes improve the quality of the image. For example, there are many factors contributing to the image created on the textile. As a starter, these include the ink employed and the textile printed upon. Different inks behave differently and different textiles act differently.

Inks include Plastisol (with and without additives, such as expanding inks), water based inks, PVC/Phalate Free, discharge inks (which remove die), foil, glitter/shimmer, metallic, caviar beads, glosses, nylobond, mirrored silver and other solvent based inks. Textiles include natural and artificial fibers from animals (e.g., wool and silk), plants (e.g., cotton, flax, jute, hemp, modal, piña and ramie), minerals (e.g., glass fibers) and synthetics (e.g., polyester, aramid, acrylic, nylon, spandex/polyurethane, olefin, ingeo and lurex). Each combination of ink and textile will demonstrate different properties, such as those associated with wicking, holding, hand, penetration and appearance. Accordingly, a one-size-fits-all approach does not necessarily produce the best results. Specifically, it has been found the appearance of an image will change on a textile with multiple printings at the same or different pressures. For example, performing three print strokes while incrementally increasing the squeegee's pressure on the screen (and hence the textile) will produce different results than performing three print strokes while incrementally decreasing the squeegee's pressure on the screen. With one combination of ink and textiles the multiple strokes increasing may be better and with another combination of ink and textiles the multiple strokes decreasing may be better.

In summary, permitting one to selectively increase the number of print strokes by a squeegee and vary the pressure applied by the squeegee gives one additional options and important tools towards improving the final printed product.

Applicants of the present invention have also recognized the final image on the textile can often be greatly improved if the textile is "kissed" by the screen during the last print stroke by the squeegee. This so-called kissing of the textile is accomplished by using as little pressure on the screen as possible so as to have the textile barely touching the screen when the squeegee passes thereover forcing the ink therethrough. As a result, the last print stroke is at a very low squeegee pressure.

In addition to the above, fibrillation is a common issue in screen printing upon textiles. It generally means "fibers showing through." It exists when fibers break through the layer of ink laid thereinover. Specifically, instead of the ink totally covering the textile, sporadic fibers will appear on the outermost surface of the ink. This will give the product an unfinished or imperfect look. It will frequently affect the appearance of the print for the color of the textile will appear in the print giving the image a washed-out appearance. Fibrillation may also cause poor resolution when the desired design relies on the textile substrate for very small or fine parts of the design.

It has been found that abrasion of the area print upon can cause the fibers of the textile to break loose from the surface of the ink, giving the print a 'washed-out' appearance.

Fibrillation is dependant on many variables, such as the ink weight and viscosity, type of ink, type of textile and the weave of a textile. For example, it is believed that the higher the ink weight the lesser the chance of fibrillation. In addition, the tighter the fibers on the surface of the textile the lesser the chance of fibrillation. Other factors affecting fibrillation include the design of the print, the gaps in the screen and thickness of the screen, viscosity of the ink, and the cure times, also are factors.

One solution is to print the textile, flash it and overprint it with a clear plastisol or water-based clear ink. This has been found to minimize fibrillation. However, this can cause a glossing or mottling effect.

Applicants of the present invention have observed that one cause of fibrillation is the pressure applied by the squeegee during the print stroke. Specifically, when the print stroke is completed, the screen rebounds from the textile. At the same time, both ink and fibers are drawn away from the textile. The result is that at times, fibers can be drawn further from the textile than the ink causing fibers to overlay or rest on top of the outer layer of ink.

Applicants have found that reducing the pressure to the squeegee on the last stroke draws fewer fibers and covers the fibers drawn by prior print strokes. Accordingly, a last kissing stroke can rectify fibrillation or minimize it.

The present invention is provided to solve the problems discussed above and other problems, and to provide advantages and aspects not provided by prior automated printing machines of this type. A full discussion of the features and advantages of the present invention is deferred to the following detailed description, which proceeds with reference to the accompanying drawings.

SUMMARY OF THE INVENTION

An aspect of the present invention is directed to an automated screen printing apparatus comprising a multi-stroke printing head and a means for controlling a source of pressure. The multi-stroke printing head has a squeegee operatively engaged with the source of pressure. The source of pressure transfers a force to the squeegee during printing. The means for controlling the source of pressure selectively varies a force applied to the squeegee from a first applied force applied during a first stroke to a second applied force applied during a subsequent stroke.

The first aspect of the invention described above may include one or more of the following features, alone or in any combination. For example, the first applied force may not be equal to the second applied force. The means for controlling the source of pressure may selectively vary the force applied to the squeegee from the first applied force applied during the first stroke to a plurality of applied forces applied during a plurality of corresponding subsequent strokes. A digital voltage regulator may provide the means for controlling the source of pressure. An analog signal may provide the means for controlling the source of pressure. The apparatus may further comprise a pressure gauge adjacent the multi-stroke printing head, a control panel for selectively controlling the means for controlling the source of pressure, and/or a pressure display on the control panel. The means for controlling the source of pressure may be adjustable via a display panel spaced from the printing head. The means for controlling the source of pressure may be adjustable at the multi-stroke printing head. Thus, the means for controlling the source of pressure may be adjustable at a plurality of locations positioned about the apparatus, including a remote location. The means for controlling the source of pressure may be disabled wherein the first applied force applied during a first stroke and the second applied force applied during a subsequent stroke are equal in magnitude. At least one piston may be provided to transfer the first and second forces to the squeegee.

Another aspect of the present invention is directed to a printing head for an automated screen printing machine. The printing head comprises a squeegee operatively engaged by a source of pressure and a means for varying a force applied by the source of pressure to the squeegee.

This aspect of the invention may include one or more of the following features, alone or in combination. The means for varying the force applied by the source of pressure to the squeegee may selectively vary the force applied to the squeegee from a first applied force applied during a first stroke to a second applied force applied during a subsequent stroke. The first applied force may not be equal to the second applied force. The print head may further comprise a flood bar adjacent the squeegee operatively engaged by a source of pressure.

Another aspect of the present invention is directed to a method of screen printing a fabric target using an automated screen printing apparatus comprising at least one printing head having a flood bar for delivering a quantity of fluid to a screen and a squeegee for applying a force by which at least a portion of the fluid passes through the screen to the fabric target. The method comprises the steps of: (1) providing a first relative movement between the squeegee and the screen; (2) providing engagement between the squeegee and the screen with a first force between the squeegee and the screen during the first providing relative movement step; (3) providing a second relative movement between the squeegee and the screen; and (4) providing engagement between the squeegee and the screen with a second force between the squeegee and the screen during the second providing relative movement step wherein the first force is not equal to the second force. The screen may be laden with a printing fluid.

Another aspect of the present invention is directed to a turret-style printing apparatus. The apparatus comprises a plurality of radial arms, a target area, a means for providing relative movement between the target area and the printing head, a means for providing a pressure between the squeegee and the target area, and a means for regulating a pressure between the squeegee and the target area. The plurality of radial arms each have a printing head associated therewith. The target area is in alignment with at least one printing head wherein a design is applied to a target article at the target area by the printing head. The means for providing relative movement between the target area and the printing head provides relative movement for multiple passes between a squeegee and the target area. The means for regulating the pressure between the squeegee and the target area regulates such that a first pressure between the squeegee and the target area on a first stroke is not equal to a second pressure between the squeegee and the target area on a subsequent second stroke.

Another aspect of the present invention is directed to a method of screen printing a fabric target. The method comprises the steps of: (1) providing a printing head including screen having a pattern thereon, a flood bar for delivering a quantity of an ink to the screen and a squeegee for applying a force by which at least a portion of the ink passes through the screen to the fabric target; (2) providing an electro-mechanical means for providing movement to the flood bar and the squeegee across the screen; (3) providing a source of pressure for applying a force to the squeegee against the screen; and (4) providing a means for regulating the source of pressure wherein the force applied to the squeegee may be automatically varied from a first magnitude of force applied on a first stroke of the squeegee across the screen to a second magnitude of force applied on a second stroke of the squeegee across the screen wherein the second magnitude of force is less than the first magnitude of force.

BRIEF DESCRIPTION OF THE DRAWINGS

To understand the present invention, it will now be described by way of example, with reference to the accompanying drawings in which.

DETAILED DESCRIPTION

Figure 1:
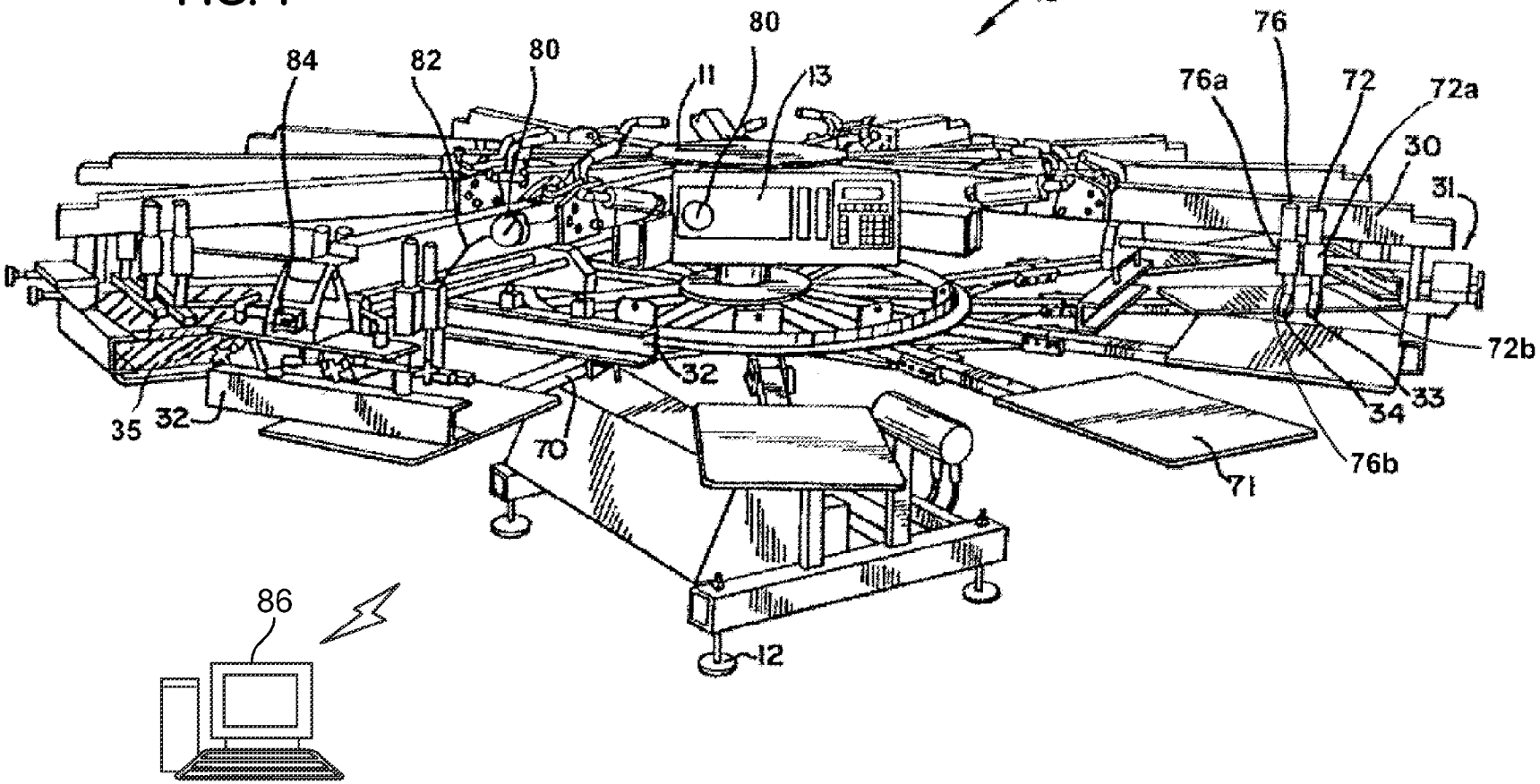
FIG. 1 view of a turret screen printing apparatus of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a typical turret style automated multi-stroke printing press 10 is shown, including a central turret or base section 11 supporting a plurality of spaced apart, spoking, radial upper arms 30 and radial lower arms 70. In the embodiment shown, the distal ends of the lower arms 70 support metal pallets, flat beds, or platens 71 for carrying a target article, e.g., a textile, a rug, or other substrate (not shown), to be printed upon. The distal ends of the upper arms 30 support printing heads 31 or conventional, well-known curing units (not shown), such that a curing station or printing head 31 is associated with each arm 30. While the machine of the present invention is shown and described having upper arms supporting printing heads or curing units and the lower arms supporting pallets, it is, of course possible for the upper arms to support the pallets and the lower arms to support the printing heads or curing units.

One of the sets of arms 30,70 rotates around the base section 11. In the embodiment shown, the lower arms 70 rotate relative to the upper arms 30. This base section 11 includes, among other things, the unit's 10 supporting feet 12 and control panel 13.

The typical printing head includes a flood bar 33, a squeegee 34, and a screen 35 (shown on a single printing head 31) supported by opposed arms 32. Relative movement between the flood bar 33 and a target area, which may include the screen 35, a target article, and the pallet 71, causes the flood bar 33 to bring paint or ink to the screen 35. Upon a relative movement by the squeegee 34 and the target area, the ink is applied across the screen 35 by the adjacent squeegee 34. Together, a print is formed on the textile.

These printing heads, or curing units, form stations. Ten (10) such stations are shown in FIG. 1. The pallet 71 with the textile thereon is rotated, indexed and registered at each station where the textile is worked on, that being either printed upon or cured. Each arm 70 and pallet 71 rotates through the ten stations. While it is appreciated the upper arms can rotate relative to the lower arms or the pallets and printing heads can be reversed, the present invention will be discussed with the stationary printing heads attached to the upper arms and the rotating pallets attached to the lower arms.

Figure 2:
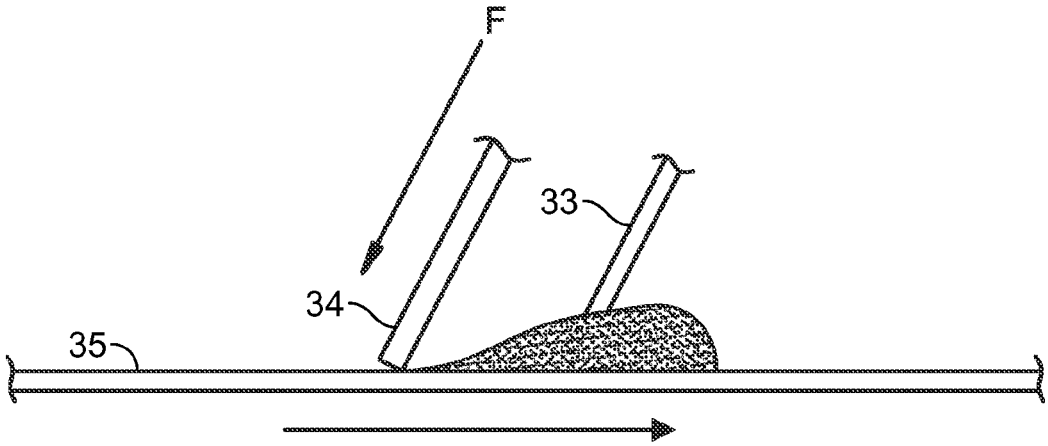
FIG. 2 is a perspective view of a print head in a first position.
Figure 3:
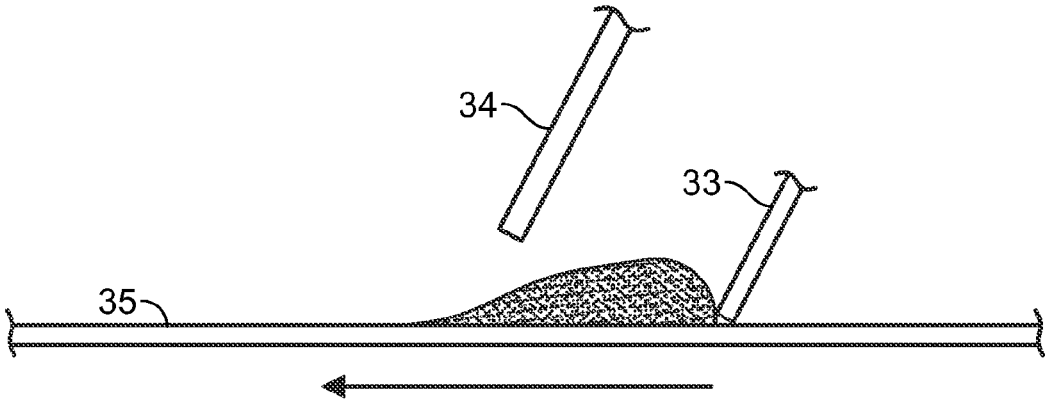
FIG. 3 is a perspective view of a print head in a second position.

As illustrated in FIGS. 2 and 3 and as described above, the flood bar 33 draws ink or paint across or to the screen 35. The squeegee 34 forces the ink or paint through openings in the screen 35 by applying pressure as it is wiped across the screen. Each such pass by the flood bar 33 and the squeegee 34, designated by arrows, is called a stroke. One or more strokes may be carried out at each station. On each stroke, the flood bar 33 is lowered under pressure supplied by a set of flood bar pistons 72. The relative movements by the flood bar 33 and the squeegee relative to the target area, are lateral movements or along a length of the arms 30 controlled by servo motors (not shown). This means for providing lateral movement or strokes may be performed by any number of electro-mechanical devices including pulleys, screws, levers, hinges, cams, etc. without departing from the spirit of the invention.

On a return pass, the flood bar pistons 72 remove pressure from the flood bar 33 such that the flood bar 33 is raised. At the same time, a set of squeegee pistons 76 provide a downward force (F) on the squeegee 34 while the electro-mechanical servo motors control the lateral return pass, with pressure on the screen 35 supplied by the squeegee 34, to complete the stroke. Broadly stated, engagement between the squeegee 34 and the fluid-laden screen 35 is accomplished by a first force (F) between the squeegee 34 and the screen 35 during the relative movement between the screen 35 and the squeegee 34. Preferably, the squeegee 34 is operatively engaged with a source of pressure, in the preferred embodiment a piston assembly, the source of pressure transfers the force (F) to the squeegee 34 to bring the squeegee 34 into engagement with the ink wherein the ink passes through the pattern on the screen to a target article at a target location or area in alignment with the screen 35, preferably a textile supported beneath a screen 35 on a pallet 71. This engagement step is performed during a pass by the squeegee 34 over the laden screen 35.

It is not necessary for the downward force (F) acting on the squeegee 34 to be provided by a piston. Several other means for applying the pressure can be provided without departing from the spirit of the invention. For example, mechanical means may be employed, such as gears, cams, screws, levers, servo-motors, and the like without departing from the spirit of the invention.

Each piston 72,76 has a fluid pressure line 82 (gas or hydraulic) in communication with a chamber 72*a*,76*a*. The piston rods 72*b*,76*b* transfer a pressure to the flood bars 33 and the squeegees 34, respectively. The transfer pressure is selectively variable via a control means associated with the control panel 13. Accordingly, through a first stroke the transfer pressure may be a first pressure value while the transfer pressure may be a second pressure value, higher or lower, on the second stroke. The second stroke may provide the kiss-level force (F) described earlier. Stated another way, each station has a printing head which is capable of a plurality of strokes to supply patterned ink or paint to a target article to be printed upon with a design, typically a textile or rug. Each subsequent stroke may be provided at a different squeegee pressure than a stroke before it.

Figure 4:
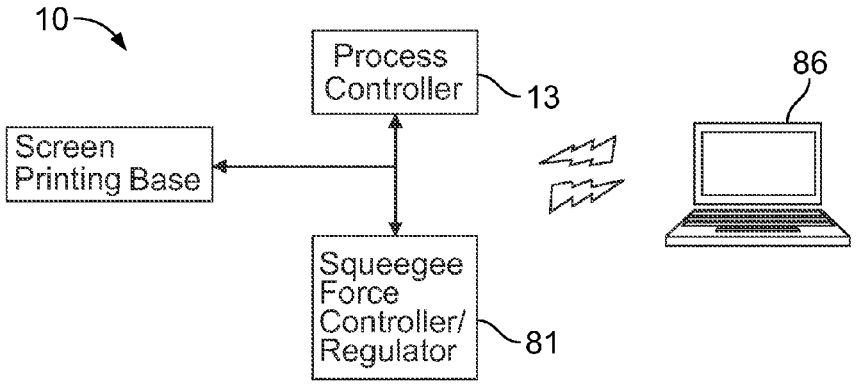
FIG. 4 is a block diagram of an aspect of the present invention.

A further controlling means of the automated screen printing apparatus 10 of the present invention further includes a means for controlling the number of strokes at each station while the source of pressure is also controlled or regulated. Thus, from a control panel 13, a user may selectively the number of strokes while varying or regulating the force (F) applied to the squeegee 34 from a first magnitude of an applied force (F) applied during a first stroke to a second magnitude of an applied force (F), e.g., greater than, less than, or equal to the first applied force (F), during a subsequent stroke. Thus, the control panel 13 includes a means for programming, controlling, or regulating 81 the magnitude of force (F) delivered by the squeegee 34 across the screen 35. (See FIG. 4). These forces may be varied over multiple strokes to as many as nine or more pressure/force (F) variations on nine or more strokes.

Typically, control of the apparatus functions is accomplished at the control panel 13. However, these functions may also be carried out at a small terminal controller 84 at each printing head 31 or remotely via personal computing device, PDA, etc 86 and monitored on any number of gauges 80 located on the control panel 13, near or adjacent the printing heads 31, and or at the remote cite.

It is contemplated that the variable pressure may be controlled by digital means (such as a digital voltage regulator, frequency, PWM, communication networks (Modbus, CAN etc.)) or by analog means, such as an analog signal in Hz (voltage 0-5V, 0-10V; current 0-20 mA, 4-20 mA). The applicants further contemplate means for disabling this function any of the control panels wherein the magnitudes of the forces applied by the squeegee 34 are generally equal in magnitude.

This apparatus 10 may be used to perform a method 200. The method of screen 35 printing a fabric target generally includes the step of providing a first relative movement between the squeegee 33 and the fluid-laden screen 35, preferably a stroke by the squeegee 34 over the ink or paint-laden screen 35. Next, an engagement between the squeegee 34 and the fluid-laden screen 35 is provided with a first force (F) between the squeegee 34 and the screen 35. This is performed during the first providing relative movement step. A second relative movement between the squeegee 34 and the fluid-laden screen 35 is carried out. At the same time, engagement between the squeegee 34 and the fluid-laden screen 35 is provided with a second force (F) between the squeegee 34 and the screen 35 wherein the first force (F) is not equal to the second force (F).

Figure 5:
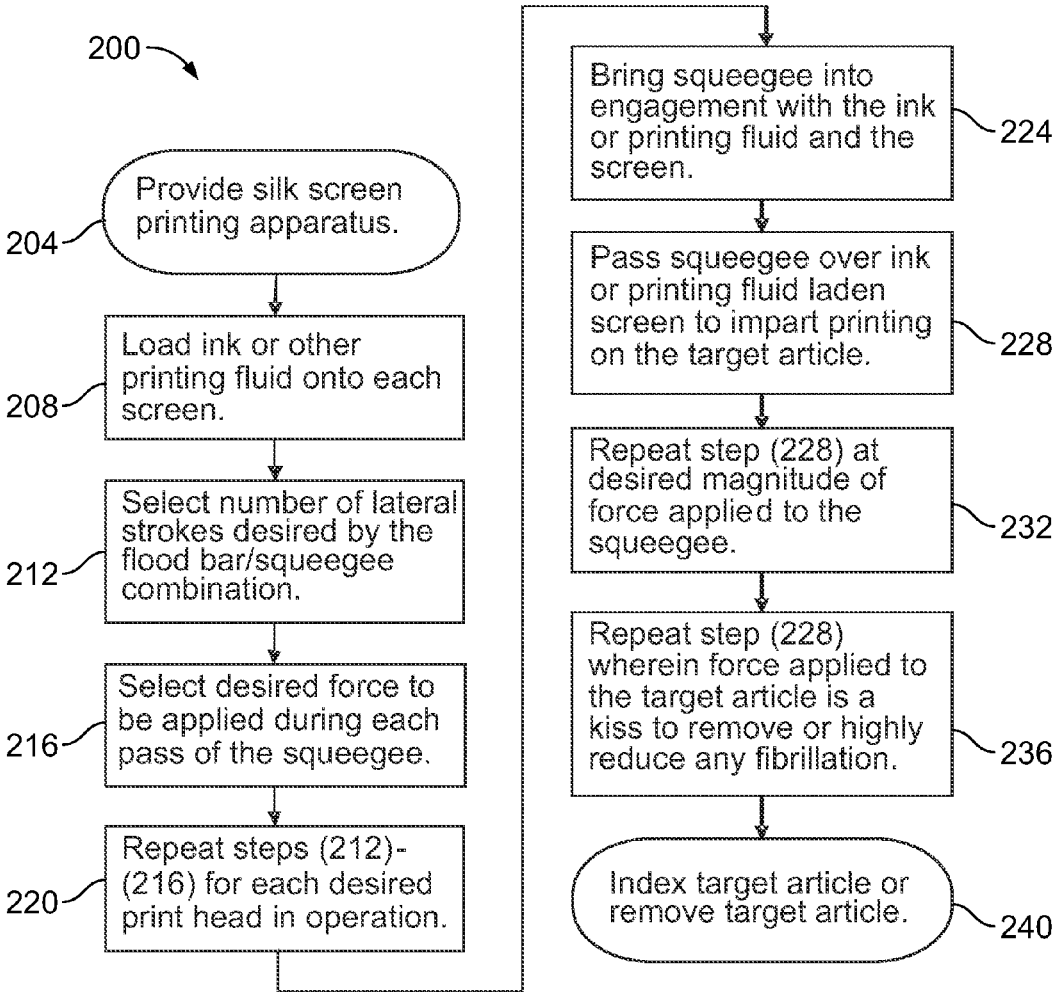
FIG. 5 is a flowchart of a method of the present invention.

One specific example or method 200 of the present invention is shown on the flowchart of FIG. 5. This method utilizes the apparatus 10 and functionality described above to accomplish the following steps: (204) provide a silk screen apparatus, preferably a turret-style screen printing apparatus having a plurality of print heads, each having a flood bar and a squeegee electo-mechanically controlled to traverse back and forth over a patterned screen; (208) load ink or other printing fluid onto the patterned screen; (212) use the controller 13, the small terminal controller 84, and/or the external controller 86 to select the number of lateral strokes by the squeegee/flood bar combination across the ink or printing fluid laden screen; (216) use the controller 13, the small terminal controller, and/or the external controller 86 with the force controller/regulator 81 to select the magnitude of force (F) delivered by the squeegee 34 across the screen 35 on each pass; (220) repeat steps (212)-(216) for each print head; (224) bring squeegee 34 into engagement with the printing fluid laden screen; (228) pass squeegee over ink or printing fluid laden screen 35 to impart printing on the target article; (232) repeat step (228) at desired magnitude of force (F) applied to the squeegee 34 by automatically varying the force (F) applied by the squeegee 34 via signal generated by the controller 13, the small terminal controller 84, and/or the external controller 86; (236) optionally, repeat step (228) wherein a force (F) applied to the target article is a kiss-level force (F) to remove or highly reduce any fibrillation; and (240)

While the specific embodiments have been illustrated and described, numerous modifications come to mind without significantly departing from the spirit of the invention, and the scope of protection is only limited by the scope of the accompanying Claims.

What is claimed is:

1. A printing head for an automated screen printing machine, the printing head comprising:

a squeegee operatively engaged by a source of pressure transferring a downward force to the squeegee as it moves across a screen during each stroke to deposit printing fluid on a fabric target; and a controller for varying a force applied by the source of pressure to the squeegee from a first applied downward force applied during a first stroke to a second applied downward force applied during a subsequent stroke, and the first applied downward force is not equal to the second applied downward force.

2. The printing head of claim 1 wherein the first applied downward force is greater than the second applied downward force.

3. The printing head of claim 1 wherein the first applied downward force is less than the second applied downward force.

4. The printing head of claim 3 further comprising:

a flood bar adjacent the squeegee operatively engaged by a source of pressure.

5. The printing head of claim 1 wherein the controller is a digital type or an analog type.

6. The printing head of claim 5 wherein the digital type uses a digital voltage regulator, frequency modulator, or a pulse width modulator.

7. The printing head of claim 5 wherein the analog type uses an analog signal representative of voltage or current.

8. The printing head of claim 1 further comprising a pressure gauge adjacent the printing head.

9. The printing head of claim 1 further comprising a control panel for selecting the first applied downward force and the second applied downward force.

10. The printing head of claim 1 wherein the controller regulates the number of strokes of the squeegee.

11. The printing head of claim 1 wherein the source of pressure is a piston, gears, cams, screws, levers, or servomotors.

12. The printing head of claim 1 wherein the source of pressure is a piston.

13. The printing head of claim 1 further comprising a means for accessing the controller remotely.

14. The printing head of claim 13 wherein the means for accessing the controller remotely includes a personal computing device, or a personal digital assistant.

* * * * *